US008749178B2

(12) United States Patent
Metzmacher et al.

(10) Patent No.: US 8,749,178 B2
(45) Date of Patent: Jun. 10, 2014

(54) ELECTRODE SYSTEM, IN PARTICULAR FOR GAS DISCHARGE LIGHT SOURCES

(75) Inventors: Christof Metzmacher, Raeren (BE); Jeroen Jonkers, Aachen (DE); Rolf Theo Anton Apetz, Aachen (DE)

(73) Assignee: Koninklijke Philips N.V., Eindhoven (NL)

( * ) Notice: Subject to any disclaimer, the term of this patent is extended or adjusted under 35 U.S.C. 154(b) by 88 days.

(21) Appl. No.: 13/503,394

(22) PCT Filed: Sep. 29, 2010

(86) PCT No.: PCT/IB2010/054379

§ 371 (c)(1), (2), (4) Date: Apr. 23, 2012

(87) PCT Pub. No.: WO2011/051839

PCT Pub. Date: May 5, 2011

(65) Prior Publication Data

US 2012/0212158 A1 Aug. 23, 2012

(30) Foreign Application Priority Data

Oct. 29, 2009 (EP) ..... 09174429

(51) Int. Cl.
*H01B 5/00* (2006.01)

(52) U.S. Cl.
USPC ..... 315/326; 174/126.1

(58) Field of Classification Search
USPC ..... 315/111.21, 326; 250/522.11
See application file for complete search history.

(56) References Cited

U.S. PATENT DOCUMENTS

| | | | | |
|---|---|---|---|---|
| 7,041,993 | B2 | 5/2006 | Chandhok | |
| 7,291,853 | B2 | 11/2007 | Fomenkov | |
| 7,368,741 | B2 | 5/2008 | Melynchuk | |
| 7,446,329 | B2 | 11/2008 | Bristol | |
| 2004/0160155 | A1 * | 8/2004 | Partlo et al. | 313/231.31 |
| 2005/0031502 | A1 * | 2/2005 | Bristol et al. | 422/186.3 |
| 2010/0181502 | A1 * | 7/2010 | Van Herpen et al. | 250/504 R |

FOREIGN PATENT DOCUMENTS

| | | | |
|---|---|---|---|
| WO | 2005025280 | A2 | 3/2005 |

* cited by examiner

*Primary Examiner* — Don Le

(57) ABSTRACT

The present invention relates to an electrode system, in particular of a gas discharge device for generating EUV radiation and/or soft X-rays. The electrode system comprises at least two electrodes (1, 2) formed of an electrode material which contains Mo or W or an alloy of Mo or W as a main component. The electrode material has a fine grained structure with fine grains having a mean size of <500 nm. With the proposed electrode system, a high thermo-mechanical and thermo-chemical resistance of the electrodes is achieved. The electrode system can therefore be used in known EUV light sources using liquid Sn and being operated at high temperatures.

11 Claims, 2 Drawing Sheets

ELECTRODE SYSTEM, IN PARTICULAR FOR GAS DISCHARGE LIGHT SOURCES

BACKGROUND OF THE INVENTION

The present invention relates to an electrode system comprising at least two electrodes formed of an electrode material which comprises molybdenum (Mo) or tungsten (W) or an alloy of molybdenum or tungsten as a main component. The invention in particular relates to a gas discharge electrode system, for example a EUV and/or soft X-ray radiation generating electrode system.

Light sources emitting extreme ultraviolet (EUV) and/or soft X-ray radiation, i.e. in the wavelength region of 1-20 nm, are required for example in the field of EUV lithography or metrology. These devices are by far the most promising candidates to be the high power light source for the upcoming lithography tools of the semiconductor industry. It is known in the art how to create EUV light efficiently at a wavelength of 13.5 nm using a highly ionized plasma. The excitation of such a plasma from an EUV emitting target material may be generated by means of a high power laser beam (laser produced plasma, LPP) or by an electrical gas discharge between electrodes (discharge produced plasma, DPP).

An example of a gas discharge light source is schematically presented and described in connection with FIG. 1. In current state-of-the-art DPP based systems a change from gaseous supply to liquid metal based discharge material in conjunction with two rotating, circular electrodes is used in order to achieve higher conversion efficiencies and thus high amounts of EUV photons required for the target application. A pulsed laser triggers the discharge by evaporating at least partially some of the liquid metal, in particular tin (Sn), from the liquid surface between the electrodes (see e.g. FIG. 2). The capacitor bank is discharged through the tin vapour, creating the high current pinch discharge. There are some decisive features of this type, e.g. the metal melt supply system, the control of the layer thickness of the liquid metal on the electrodes, the necessity to at least partially evaporate the metal melt by means of e.g. a laser beam of some ten mJ pulse energy. There exist many configurations of the application of the metal melt or of the electrode arrangement, for example, however, the use of liquid Sn as a discharge media is generally accepted. Both, in DPP and LPP usually a flow of liquid target material is required to provide the plasma with the EUV emitting species.

Although the scalability to reach high power levels has been fundamentally shown quite recently, one of the potential showstoppers for high volume manufacturing is still the critical requirement of a high power source delivering >200 W at the intermediate focus which corresponds to >1000 W emitted in $2\pi$ sr by a point-like light source. In the very near future, the EUV source is expected to run continuously at about 10 kHz pulse frequency and a minimum lifetime of the order of $10^{11}$ shots has to be demonstrated. In order to achieve high radiation power, very high average electrical powers have to be fed into the source and this may lead to high electrode wear and thus short lifetimes of the electrode system. For a Xe DPP it is reported that the lifetime of the electrode system is limited by erosion and erosion rates are around 0.2 μg/shot at 11 J/shot for tungsten electrodes which results in significant less EUV output.

Apart from the decrease in lifetime, another disadvantage is due to the fact that the plasma will become spatially larger because of the change in electrode geometry, leading to the effect that only a smaller fraction of the produced light can be exploited and thus, optical performance is diminished. From the statements above it is understandable that dedicated components of the EUV generating device are more or less permanently exposed to relatively harsh physical and chemical conditions at elevated temperatures of greater than e.g. 200° C. A substantial portion of the pulse energy is concentrated in the pinch plasma which leads to thermal loading of the electrodes by the emission of radiation and of hot particles (ions, electrons). Moreover, the pulsed plasma light source is not merely emitting photons, but also producing undesired material, so called debris, such as e.g. Sn, Li, Sb, Xe, . . . depending on the nature of the source itself. In systems with extreme UV or soft X-ray radiation optical components such as mirrors or filters are in use which are close to the high-power light source. The contaminating debris may condense on these optical components whose performance consequently deteriorates and finally becomes inefficacious. To further complicate the situation there is also the prerequisite that the tin needs to be free from contamination (alien elements) in order to secure a high quality of a pure tin plasma. It is well known that pure Sn is much more aggressive than diluted solutions used e.g. in former soldering systems.

In case of the electrode system and its potential problems due to removal of electrode material, there could be several main root causes. The main drivers might be the high heat load and the high current densities along with their spatial and temporal conditions (thermo-mechanical effect). Both are related to the pulsed operation of the plasma and the small distance between the electrodes and the plasma. Due to the high heat fluxes and the high current densities electrode erosion is inevitable. In conjunction with metal melts erosion will lead to an inhomogeneous, thick and unstable layer of liquid metal and thus to a failure in discharge. The minimum thickness of liquid metal is said to be about 5 μm in order to avoid impact of the laser focus spot and cathode spots on the morphology of the electrode surface (e.g. crater formation). Too thick a layer of metal melt (beyond about 40 μm) is also disadvantageous in controlling the amount of debris material in the pinch plasma. It is also stated that erosion mechanisms may include volumetric boiling and explosion of large bubbles developed in the surface layer (of e.g. W with dissolved gases) and even splashing of the molten electrode material at the surface due surface wave excitation caused by energetic particles from the plasma.

Furthermore, another cause for the removal of electrode material can be found in the chemical corrosion due to liquid Sn at elevated temperatures (thermo-chemical effect). As this is a thermo-dynamically driven process it is more pronounced at an increased temperature level. This is not only detrimental to the electrode system by erosion, but also may reduce the EUV performance, i.e. output of EUV light, as unwished elements or reaction products which do not emit efficiently in the EUV wavelength range may become part of the discharge region. It has been shown that in particular in case of pure Sn the liquid is very aggressive to common materials such as stainless steel and gray cast irons.

WO 2005/025280 A2 discloses a gas discharge light source emitting EUV and/or soft X-ray radiation. The electrodes of this light source are disclosed to be made of Cu, W or Cu covered with Mo. These materials are highly heat conductive. Moreover, between the electrodes and the liquid metal a high electrical conductivity is also required. In case of (solid) Sn as a target material the values of electrical resistivity and thermal conductivity are 11 μΩcm and 67 W/(mK), respectively, both worse than the values of common electrode materials. Thus, the thinner the Sn layer can be made the more heat can be dissipated and the more electrical power can be coupled in. Generally, W and Mo are expected to be promising refractory transition metals for use in extreme environments. However, they are known to undergo serious embrittlement in several regimes, e.g. recrystallization embrittlement, which inevitably limits structural application of W and Mo. The weakness of the grain boundaries stems from their intrinsic character and recrystallization and embrittlement are further potential failure modes at elevated temperatures.

In case of solid electrodes, i.e. Xe DPP, a method is known to reduce electrode erosion by treating the surface of the electrode to allow for increased re-deposition of eroded electrode material into fabricated grooves. Alternatively, coatings by a porous material to reduce erosion due to brittle destruction is also proposed. In another known technique, dedicated sputter deposition is mentioned to regenerate the electrodes by material and account for the loss.

DESCRIPTION OF THE INVENTION

It is an object of the present invention to provide an electrode system for use in a gas discharge device, in particular in a gas discharge light source for generating EUV and/or soft X-ray radiation, which electrode system has a high thermo-mechanical and thermo-chemical resistance resulting in reduced electrode erosion in such a gas discharge device or light source.

The object is achieved with the electrode system according to claim 1. Advantageous embodiments of the proposed electrode system are subject matter of the dependent claims or are disclosed in the subsequent portions of the description. Claim 7 further relates to the use of the proposed material of the electrodes for other components of a gas discharge light source. Claim 8 relates to a gas discharge light source comprising the proposed electrode system.

The proposed electrode system comprises at least two electrodes formed of an electrode material, which comprises Mo or W or an alloy of Mo or W as a main component. Main component means that this element or alloy represents the highest fraction (by weight) of all substances of which the electrode material is formed. Preferably this element or alloy represents a fraction of ≥95 wt. % of the total weight of the electrode. In the proposed electrode system, the electrode material has a fine grained structure with fine grains having a mean size of ≤500 nm, preferably between 50-300 nm. The grain size of the electrode bulk material can be determined in a cut of the electrode in which the grain size can be microscopically identified. The electrode bulk material always contains a distribution of grain sizes, wherein the mean value of all grain sizes of this distribution is ≤500 nm. In order to achieve this property of the electrode material, the process of manufacturing the electrodes has to be especially chosen and controlled to maintain these small grain sizes throughout the process.

With the proposed electrode material, the thermo-mechanical as well as the thermo-chemical resistivity is achieved, in particular against high temperatures of about 1200 K and against the influence of liquid Sn. This allows the electrode system to be used in gas discharge light sources generating EUV and/or soft X-ray radiation by a hot plasma delivering the target radiation, which plasma is produced by a pulsed current of the electrode system. Due to the reduced erosion of the proposed electrode material the electrode degradation is minimized, decrease of performance of such a light source within its lifetime is avoided and lifetime is enlarged.

The proposed electrodes provide a high thermal shock resistance, a high thermal diffusivity, a high recrystallization temperature and a high corrosion resistance against liquid metals like liquid Sn. The material also allows for a thin, uncritical reaction zone to the liquid metal in order to realize good wetting and adhesion of the liquid metal on the surface of rotating electrodes, i.e. in case of a special embodiment of a gas discharge light source in which this electrode system can be used. Uncritical in this sense means a quickly saturated and finished reaction to primarily allow for adequate wetting but without ongoing further reaction and thus inhibited corrosion. In addition to that and basically, the proposed electrode material reveals an electrical resistivity of <100 μΩcm and a thermal conductivity of >20 W/(mK).

In one form of approximation, the thermal shock resistance $R_s$ can be related to the thermo-mechanical properties such that $$R_s=\lambda\sigma/E\alpha,$$

with λ as thermal conductivity, σ as tensile strength, E as Young's modulus of elasticity, and α as coefficient of linear expansion. It is important to note that thermal shock behaviour is related to crack initiation (as expressed by the above equation) and crack propagation. In the first stage, if $R_s$ is large, there is only a small chance that flaws are initiated. In the second stage, i.e. if cracks are present, the damage resistance or extent of crack propagation by thermal shock is $$\sim(K_{1c})^2\sim\sigma^2,$$

with $K_{1c}$ as fracture toughness (subscript: mode 1=crack opening and ordinary strain). Thus, $K_{1c}$ describes the resistance of a material to failure from fracture starting from a pre-existing crack.

Another important parameter is the thermal diffusivity which is related to thermal conductivity by $$\kappa=\lambda/\rho c_p,$$

with ρ as mass density. Materials with high thermal diffusivity quickly reduce their initial temperature gradients to that of their surroundings because they conduct heat fast in comparison to their volumetric heat capacity or 'thermal bulk' $c_p$.

The proposed material has improved high temperature mechanical properties such as fracture toughness and tensile strength. In an advantageous embodiment, this electrode material is synthesized with small amounts of doping to achieve further optimized properties. The doping is made with dispersed nano-sized particles, preferably up to an amount of 5 wt. %. Examples of such dispersion particles are $La_2O_3$, $HfO_2$, C, $Y_2O_3$, $CeO_2$, $TiO_2$ and especially carbides such as TiC, ZrC and TaC. With such additional material, the grain boundaries are strengthened so as to suppress intergranular fracture and thus brittleness, since the dispersed particles segregate predominantly at these grain boundaries. Such an electrode material having nanostructures or ultrafine grains, e.g. 50-300 nm Mo, with small amounts of nano-sized dispersoids, e.g. 1.5 wt. % TiC, is also thermally very stable.

In a further embodiment, the electrodes are additionally coated at least at areas underlying the highest thermo-mechanical and/or thermo-chemical charge with a ceramic material. Such materials has revealed themselves not only to fulfill the electrical and thermal requirements, but also to be unaffected by corrosion attack by liquid metal due to its covalent nature of bonding. Preferred materials with appropriate characteristics comprise the ceramics of borides, carbides, nitrides and silicides of the refractory transition metals of group IV B, V B and VI B. Transition metal borides, nitrides, carbides and silicides exhibit characteristics of covalent, ionic and metal bonding. They have high thermal and electrical conductivities while the covalent nature gives rise to outstanding mechanical chemical properties. These materials allow extensive use as both wear-protective as well as decorative coating. Most of the compounds are completely soluble in each other and thus allow for a further extended tailoring of the properties. For example, the thermal fatigue effects in WC caused by repeated thermal shocks due to internal flaws that grow during each shock, can be reduced by e.g. Co doped cemented tungsten carbide. The materials can be grown by conventional film deposition techniques such as PVD or CVD, but also by e.g. thermo-chemical diffusion or infiltration. The coating material has to be selected to have a similar thermal expansion coefficient than the underlying electrode material. The thickness of the coating is in the range of 1-50 μm.

The proposed electrode material may also be used in other components of a gas discharge system, in particular a gas discharge light source generating EUV and/or soft X-ray radiation. Examples for such components, in particular of the source-collector module of a EUV light source, are components with high thermal and/or electrical input. These components normally are located close to the electrodes such as so called wedges, but also may comprise covering parts of the system and devices of the debris mitigation system. This may be related to all critical locations where e.g. heat has to be conducted efficiently out of the system to the heat sinks An example is the front heat shield of the foil trap of a EUV discharge light source, which is directly and closest positioned to the EUV source, or the inner and outer surface of the rotational axis of the foil trap. But also dedicated devices of the gas discharge system are affected by this idea, namely the thermal sensor as an intermediate focus diagnostic or cover plates to avoid unwanted gas flows. It is obvious that this listing is not complete and may comprise also other components.

In an advantageous embodiment, the proposed electrode system is part of a gas discharge device, in particular a gas discharge light source generating EUV radiation and/or soft X-rays. Such a gas discharge light source comprises a gas discharge chamber in which the electrode system is arranged and a power supply for applying a pulsed current to the electrodes of the electrode system. In case of a EUV and/or soft X-ray light source, preferably the electrodes are rotatably mounted and driven to rotate during operation of the light source by a driving unit, and a supply device for supplying a liquid metal to the surface of the electrodes is provided. Such a EUV and/or soft X-ray gas discharge light source also comprises a laser light source to evaporate the liquid metal on the surface of the electrodes. An example for such a gas discharge light source, in which the proposed electrode system can be used, is disclosed in WO 2005/025280 A2, which has been mentioned in the introductory portion of the description.

BRIEF DESCRIPTION OF DRAWINGS

The proposed electrode system and corresponding gas discharge light source are described in the following by way of example in connection with the accompanying figures without limiting the scope of protection as defined by the claims. The figures show:

DETAILED DESCRIPTION OF EMBODIMENTS

Figure 1:
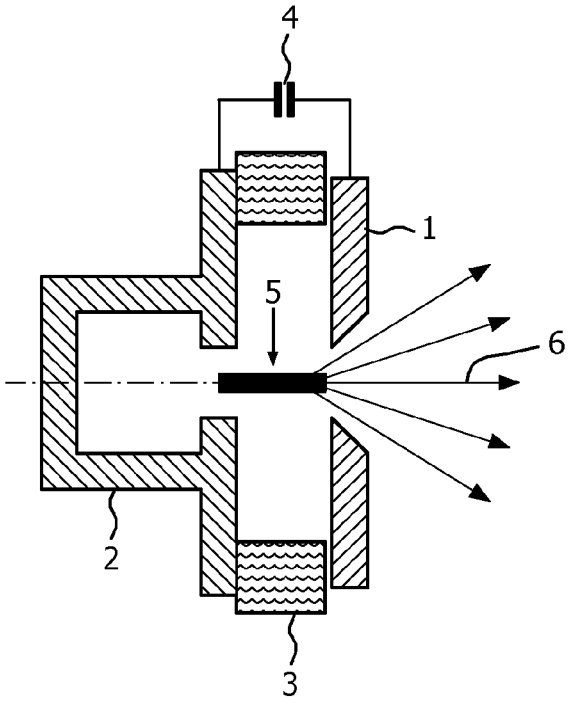
FIG. 1 a first example of a gas discharge light source with the proposed electrode system.

FIG. 1 shows an example of a gas discharge light source in which the proposed electrode system may be arranged. The gas discharge light source comprises two electrodes (anode 1, cathode 2) which are arranged in a discharge chamber (not shown in the figure). The two electrodes 1, 2 are separated by an isolator 3 to form a gap. The required electrical energy for a pulsed operation of the gas discharge light source is supplied by means of a capacitor bank 4 in which the energy is first stored and then discharged via the electrodes 1, 2. The gas discharge chamber is filled with a discharge material at pressures in the range of typically 1-100 Pa. By virtue of magnetic compression due to the application of a pulsed current typically a view tens of kA to at most 100 kA and pulse durations of typically a few tens of ns to a few hundred ns, the pinch plasma 5 formed between the electrodes 1, 2 is heated up to temperatures of few tens of eV. Due to the high temperatures of the pinch plasma 5 emitting the desired radiation 6, the surface of the electrodes 1, 2 in the vicinity of the pinch plasma 5 are exposed to very high temperatures and high energetic ions. The resulting erosion of the electrodes can be reduced by using an electrode material for these electrodes as proposed in the present invention.

Figure 2:
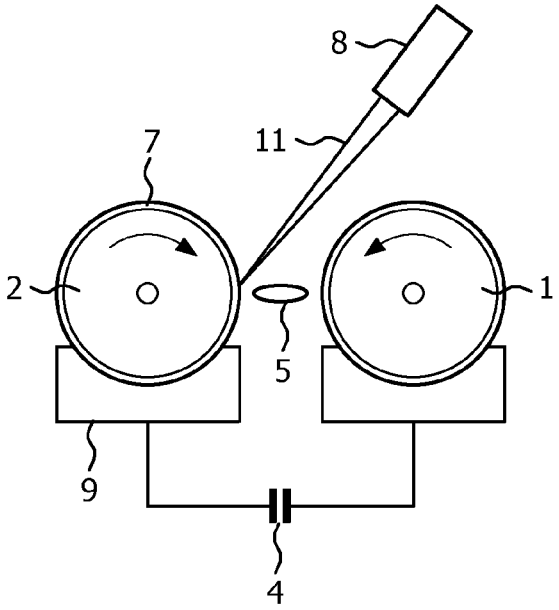
FIG. 2 a second example of a gas discharge light source with the proposed electrode system.

FIG. 2 shows a further example of a gas discharge light source in which the electrode system according to the present invention can be used. This gas discharge light source is designed to generate EUV radiation and/or soft X-rays. The two electrodes 1, 2 in this example are rotatably mounted and supplied with a liquid Sn film 7 on their surface. Instead of a gaseous supply of the necessary material for generating the radiation, in this gas discharge light source a liquid metal based discharge material is used in conjunction with the two rotating, circular electrodes 1, 2. This results in higher conversion efficiencies and thus higher amounts of EUV photons required for the target application. The pulsed laser 8 triggers the discharge by evaporating at least partially some of the Sn from the liquid surface of one of the electrodes 1, 2. The capacitor bank 4 is discharge through the tin vapor, creating the high current pinch discharge 5. The liquid Sn film 7 is supplied via a special supply system, in the present example by dipping the rotating electrodes 1, 2 in a container 9 containing liquid Sn. The layer thickness of the liquid metal on the electrode surface is additionally controlled with appropriate strippers (not shown in this figure). Although in this example, the supply of the liquid Sn is made via the containers 9, it is obvious, that the liquid metal may also be applied by other measures to the electrode surface.

In order to achieve a high thermo-chemical resistance against the liquid Sn on the electrode surface and to achieve a high thermo-mechanical resistance of the electrodes, the two electrodes are made of the material proposed in the present invention. This results in a significantly higher life time of the gas discharge light source.

Figure 3:
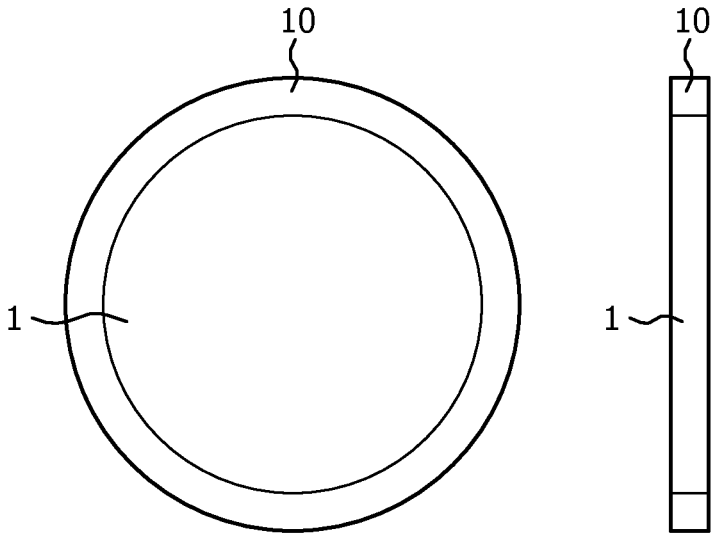
FIG. 3 a schematic illustration of a coating on top of the electrode.

The surface of the electrodes of the electrode system in the present invention may also be additionally coated, for example with a ceramic coating. FIG. 3 schematically illustrates such a coating 10 of an electrode 1 which for example can be used in the gas discharge light source of FIG. 2. The coating is only applied at the surface portions which are exposed to the highest temperature and to the liquid Sn.

In order to achieve the properties of the electrode material with the small grain sizes, the process of manufacturing such an electrode has to be selected and controlled appropriately. A skilled person is able to control the process to this end. In the following, an exemplary embodiment for achieving the small grain of the electrode material is described. The raw material for the electrode in this case is provided as a powder with a mean particle size of ≤500 nm. To obtain nano-structured refractory alloys according to the invention, the electrodes are formed of this raw material by e.g. powder metallurgical processing. First, the starting powder of pure materials or solid solution alloys is treated by mechanical milling. In order to increase densification the powder is subsequently sintered at relatively low temperatures at which grain growth of the nano-sized materials is strongly inhibited. Furthermore, e.g. hot isostatic pressing can be effectively applied to essentially maintain the initial order of grain size.

While the invention has been illustrated and described in detail in the drawings and forgoing description, such illustration and description are to be considered illustrative or exemplary and not restrictive, the invention is not limited to the disclosed embodiments. The different embodiments described above and in the claims can also be combined. Other variations to the disclosed embodiments can be understood and effected by those skilled in the art in practising the claimed invention, from a study of the drawings, the disclosure and the appended claims.

In the claims the word comprising does not exclude other elements or steps, and the indefinite article "a" or "an" does not exclude a plurality. The mere fact that measures are recited in mutually different dependent claims does not indicate that a combination of these measures can not be used to advantage. Any reference signs in the claims should not be construed has limiting the scope of this claims.

LIST OF REFERENCE SIGNS

1 electrode (anode)
2 electrode (cathode)
3 isolator
4 capacitor bank
5 pinch plasma
6 radiation
7 Sn film
8 laser
9 container with liquid Sn
10 coating
11 laser beam

The invention claimed is:

1. An electrode system comprising:
at least two electrodes formed of an electrode material including
a main component selected from a group comprising Mo, W, an alloy of Mo and an alloy of W, and
a fine grained structure with fine grains having a mean size of ≤500 nm.

2. The electrode system according to claim 1, wheren the electrode material is doped with dispersed nano-sized particles.

3. The electrotrode system according to claim 1, wherein the electrode material is doped with dispersed nano-sized particles of the group of $La_2O_3$, $HfO_2$, c, $Y_2O_3$, $CeO_2$, $TiO_2$ and metal carbides.

4. The electrode system according to claim 1, wherein the electrode material contains the dispersed nano-sized particles up to an amount of 5 wt. %.

5. The electrode system according to claim 1, wherein the electrodes are coated at least at areas underlying highest thermo-mechanical and/or thereto-chemical charge with a ceramic material.

6. The electrode system according to claim 1, further comprising a compacitor bank connected between the two electrodes for supplying electrical energy.

7. The electrodes system according to claim 1, wherein the two electrodes are rotatably mounted and each of the two electrodes has a surface that is coated with a liquid Sn film.

8. The electrodes system according to claim 7, further comprising a pulsed laser For evaporating at least partially the liquid Sn from the surface of at least one of the two electrodes.

9. An electrode system comprising:
at least two electrodes formed of an electrode material including
a main component selected from one of Mo, W, an alloy of Mo, and an alloy of W, and
a fine grained structure with fine grains having a mean size of ≤500 nm,
wherein the electrodes are coated at least at areas underlying highest thermo-mechanical and thermo-chemical charge with ceramic material formed of one of borides, carbides, nitrides and silicides of the refractory transition metals of group IV B, V B and VI B.

10. A gas discharge device comprising:
a gas discharge chamber;
at least two electrodes formed of an electrode material including
a main component selected from a group comprising Mo, W, an alloy of Mo, and an allow of W, and
a fine grained structure with fine grains having a mean size of ≤500 nm: and
a power supply electrically connected to the at least two eltrodes.

11. The gas discharge device according to claim 10, further comprising
a supply device arranged to supply liquid metal to a surface of the at least two electrodes, and
a laser arranged to evaporate a part of said liquid metal from the surface of the at least two electrodes with a laser beam,
wherein the at least two electrodes are rotatably mounted.

* * * * *